US007541786B2

(12) United States Patent
Yen

(10) Patent No.: US 7,541,786 B2
(45) Date of Patent: Jun. 2, 2009

(54) VOLTAGE REGULATOR

(75) Inventor: Chih-Jen Yen, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 15 days.

(21) Appl. No.: 11/531,691

(22) Filed: Sep. 13, 2006

(65) Prior Publication Data

US 2008/0030179 A1 Feb. 7, 2008

(30) Foreign Application Priority Data

Aug. 1, 2006 (TW) ..... 95128084 A

(51) Int. Cl.
*G05F 1/00* (2006.01)
*G05F 1/565* (2006.01)

(52) U.S. Cl. ..... 323/280; 323/275; 323/285; 323/299

(58) Field of Classification Search ..... 323/282, 323/284, 285, 299, 274–281
See application file for complete search history.

(56) References Cited

U.S. PATENT DOCUMENTS

| | | | | |
|---|---|---|---|---|
| 6,414,537 | B1 * | 7/2002 | Smith | 327/540 |
| 6,448,750 | B1 * | 9/2002 | Shor et al. | 323/282 |
| 6,518,737 | B1 * | 2/2003 | Stanescu et al. | 323/280 |
| 6,573,746 | B2 * | 6/2003 | Kim et al. | 326/30 |
| 6,828,766 | B2 * | 12/2004 | Corva et al. | 323/284 |
| 6,965,218 | B2 * | 11/2005 | Scoones et al. | 323/280 |
| 7,295,414 | B2 * | 11/2007 | Yang et al. | 361/93.9 |
| 2003/0020444 | A1 * | 1/2003 | Kamenicky | 323/315 |
| 2003/0122530 | A1 * | 7/2003 | Hikita | 323/285 |
| 2007/0222423 | A1 * | 9/2007 | Chen et al. | 323/283 |

* cited by examiner

*Primary Examiner*—Jessica Han
*Assistant Examiner*—Emily Pham
(74) *Attorney, Agent, or Firm*—Jianq Chyun IP Office

(57) ABSTRACT

A voltage regulator including a voltage regulation unit and an over driving unit is provided. The voltage regulation unit outputs a corresponding output voltage according to an input voltage. The over driving unit is coupled between an input terminal and an output terminal of the voltage regulation unit and regulates the input voltage according to the comparison result between the output voltage and a reference voltage.

11 Claims, 3 Drawing Sheets

VOLTAGE REGULATOR

CROSS-REFERENCE TO RELATED APPLICATION

This application claims the priority benefit of Taiwan application serial no. 95128084, filed Aug. 1, 2006. All disclosure of the Taiwan application is incorporated herein by reference.

BACKGROUND OF THE INVENTION

1. Field of Invention

The present invention relates to a voltage regulator. More particularly, the present invention relates to a voltage regulator capable of regulating an input voltage in real time so as to maintain an output voltage level.

2. Description of Related Art

A conventional voltage regulator provides generally a stable output voltage without considering the load effect. However, when the transient change of a load current happens, the output voltage drops if the voltage regulator cannot provide a sufficient driving current in real time. Particularly, when a larger current driving capability is required, for example, the voltage drop phenomenon of an LCD panel source driver is more severe.

FIG. 1 is a voltage regulator according to the conventional art. The voltage regulator 100 includes a voltage generator 110 and a voltage regulation unit 120. The voltage generator 110 uses the common node of a current source $I_{REF}$ and a resistor R13 to provide an input voltage INT to the negative input terminal of an operational amplifier 122. Due to the principle of virtual short circuit, the voltage at the common node of a resistor R11 and a resistor R12 is equal to the input voltage INT. At this time, an output voltage OUT is generated at the common node of the resistor R11 and a P-type transistor (PMOS transistor) P11. A capacitor $C_L$ functions as stabilizing the output voltage OUT of the voltage regulator 100, such that the output voltage OUT will not change severely along with the transient change of the load current 130. As shown in FIG. 1, the greater the load current $I_L$ changes, the more severe the output voltage OUT drops. Therefore, the voltage regulator 100 is required to effectively enhance the driving capability of the voltage regulation unit 120 when the output voltage OUT drops.

SUMMARY OF THE INVENTION

An objective of the present invention is to provide a voltage regulator capable of regulating the input voltage level to enhance the driving capability thereof when the output voltage drops due to the change of the load current.

Another objective of the present invention is to provide a voltage regulator which is applicable to drive a large current load. The driving capability of the voltage regulator is regulated in real time according to the change of the output voltage level, so as to maintain the output voltage level.

In order to achieve the above or other objectives, the present invention provides a voltage regulator, which comprises a voltage regulation unit and an over driving unit. The voltage regulation unit outputs a corresponding output voltage according to an input voltage. The over driving unit is coupled between an input terminal and an output terminal of the voltage regulation unit and regulates the input voltage according to the comparison result between the output voltage and a reference voltage.

If the output voltage does not correspond to the reference voltage, the input voltage is regulated to make the output voltage correspond to the reference voltage.

The over driving principle is adopted in the present invention to regulate the input voltage of the voltage regulator in real time according to the change of the output voltage level, so as to maintain sufficient driving capability, such that the voltage regulator quickly recovers from the voltage drop caused by the change of the load. Therefore, the voltage regulator of the present invention is applicable to a load requiring a large driving current, for example, the LCD panel source driver.

In order to make the aforementioned and other objectives, features and advantages of the present invention comprehensible, preferred embodiments accompanied with figures are described in detail below.

DESCRIPTION OF EMBODIMENTS

Figure 1:
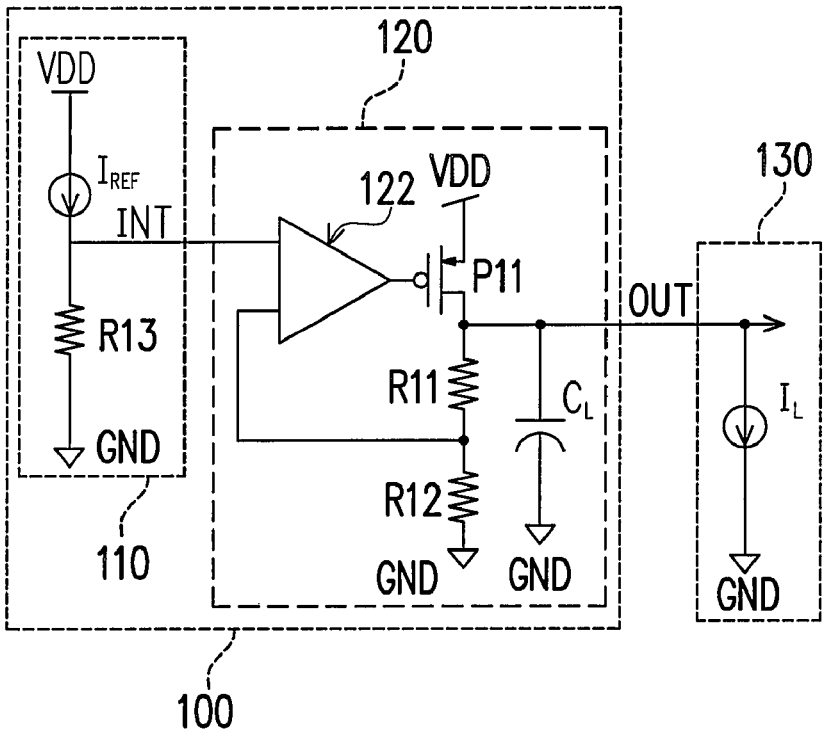
FIG. 1 (PRIOR ART)
FIG. 1 is a voltage regulator according to the conventional art.
Figure 2:
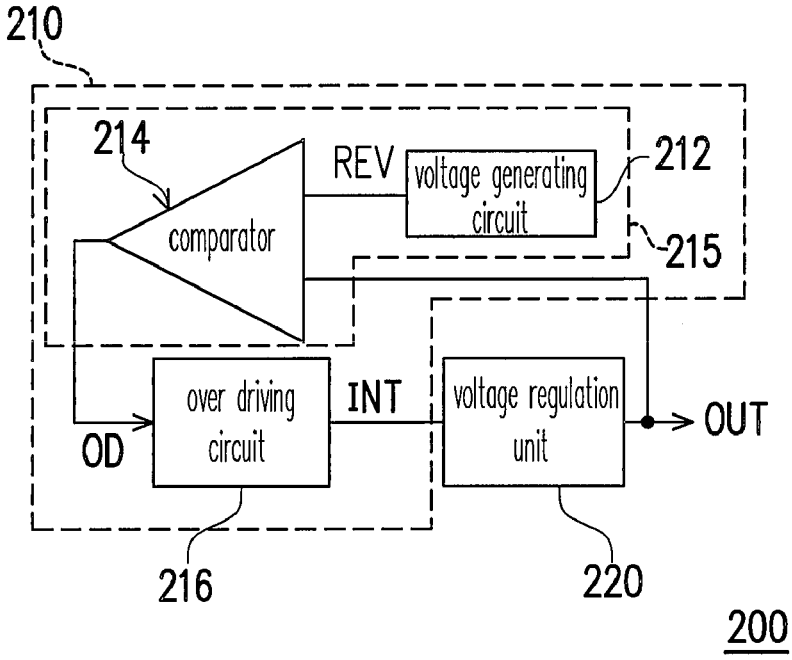
FIG. 2 is a circuit block diagram of the voltage regulator according to an embodiment of the present invention.

FIG. 2 is a circuit block diagram of the voltage regulator according to an embodiment of the present invention. The voltage regulator 200 includes an over driving unit 210 and a voltage regulation unit 220. The voltage regulation unit 220 generates an output voltage OUT according to an input voltage INT. The output voltage OUT is in a predetermined proportion to the input voltage INT, and the proportion relation is determined by the circuit architecture of the voltage regulation unit 220.

The over driving unit 210 is coupled between the input terminal and output terminal of the voltage regulation unit 220, and regulates the input voltage INT according to the comparison result between the output voltage OUT and a reference voltage REV. The over driving unit 210 includes a voltage comparison circuit 215 and an over driving circuit 216. The voltage comparison circuit 215 is coupled to the output terminal of the voltage regulator 200 for comparing the output voltage OUT and the reference voltage REV and outputting an over driving signal OD to the over driving circuit 216. The over driving circuit 216 is coupled between the voltage comparison circuit 215 and the input terminal of the voltage regulation unit 220 and regulates the input voltage INT according to the aforementioned over driving signal OD to alleviate the output voltage drop due to the transient change of the output load.

In the present embodiment, the voltage comparison circuit 215 includes a voltage generating circuit 212 and a comparator 214. The voltage generating circuit 212 is used to generate the aforementioned reference voltage REV. The comparator 214 is used to compare the output voltage OUT and the reference voltage REV, and to output the over driving signal OD according to the comparison result. In the present embodiment, when the output voltage OUT is higher than the reference voltage REV, the comparator 214 outputs the over driving signal OD of a low logic level, and when the output voltage OUT is lower than the reference voltage REV, the comparator 214 outputs the over driving signal OD of a high logic level.

Figure 3:
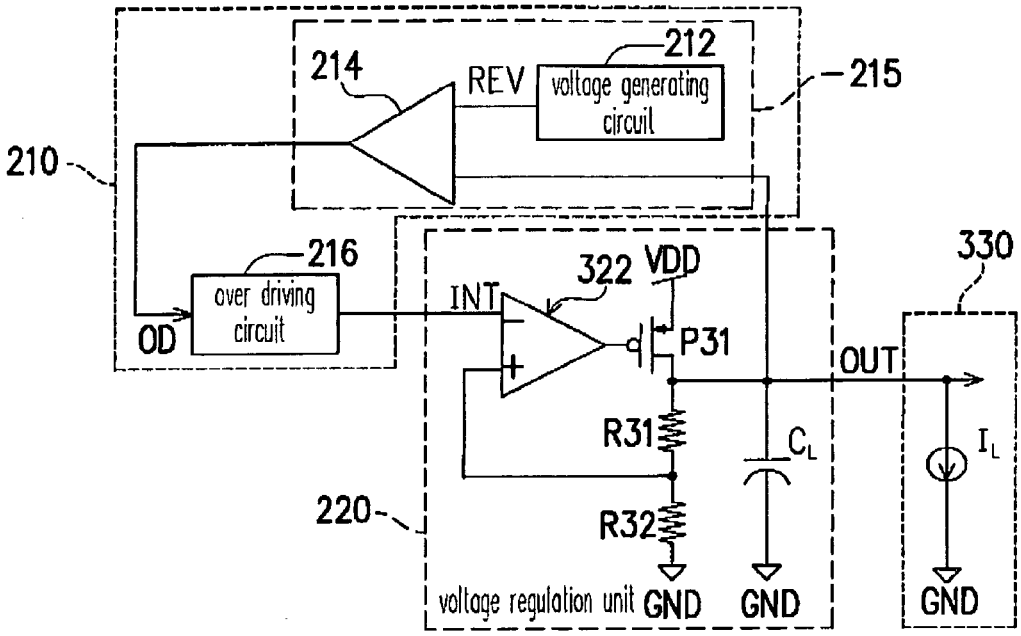
FIG. 3 is a circuit diagram of the voltage regulation unit according to an embodiment of the present invention.

Then, the voltage regulation unit 220 of the present embodiment is further illustrated. FIG. 3 is a circuit diagram of the voltage regulation unit according to another embodiment of the present invention. The voltage regulation unit 220 is coupled between the over driving unit 210 and a load 330, and generates the output voltage OUT to the load 330 according to the input voltage INT outputted by the over driving circuit 210.

In the present embodiment, the voltage regulation unit 220 includes an operational amplifier 322, a P-type transistor P31, a resistor R31, a resistor R32, and a capacitor $C_L$. The negative input terminal of the operational amplifier 322 is coupled to the input voltage INT, and the positive input terminal of the operational amplifier 322 is coupled to the common node of the resistors R31, R32. The P-type transistor P31 is coupled between an operating voltage VDD and the resistor R31, and the gate of the P-type transistor P31 is coupled to the output terminal of the operational amplifier 322. As the operational amplifier 322 is characterized by the virtual short circuit, the voltage level of the positive input terminal of the operational amplifier 322 changes along with the voltage level of the negative input terminal (input voltage INT). Thus, the output voltage OUT is equal to INT*[1+(R31/R32)], wherein INT indicates the voltage value of the input voltage INT, and R31, R32 represent the resistance value of the resistors R31, R32 respectively. Accordingly, the relative relation between the output voltage OUT and the input voltage INT can be regulated only by regulating the proportion of the resistors R31, R32. The capacitor $C_L$ functions as stabilizing the output voltage OUT of the voltage regulation unit 220, such that the output voltage OUT does not change severely along with the transient change of the load current $I_L$.

In the present embodiment, when the voltage comparison circuit 215 is in a steady state, the output voltage OUT is higher than the reference voltage REV, the over driving signal OD is in a low logic level, and the load 330 is indicated by the equivalent load current $I_L$. When the transient change of the load 330 happens, the output voltage OUT drops. When the output voltage OUT is lower than the reference voltage REV, the over driving signal OD turns to a high logic level. Therefore, the over driving unit 210 increases the input voltage INT, and further enhances the driving capability of the operational amplifier 322, such that the current conducted by the P-type transistor P31 rises quickly. Moreover, the higher current conduction capability can be used to quickly increase the output voltage OUT, so as to alleviate the output voltage OUT drop. When the output voltage OUT returns to be higher than the reference voltage REV, the over driving signal OD returns to a low logic level, and the over driving unit 210 regulates the input voltage INT to the initial voltage level.

Figure 4:
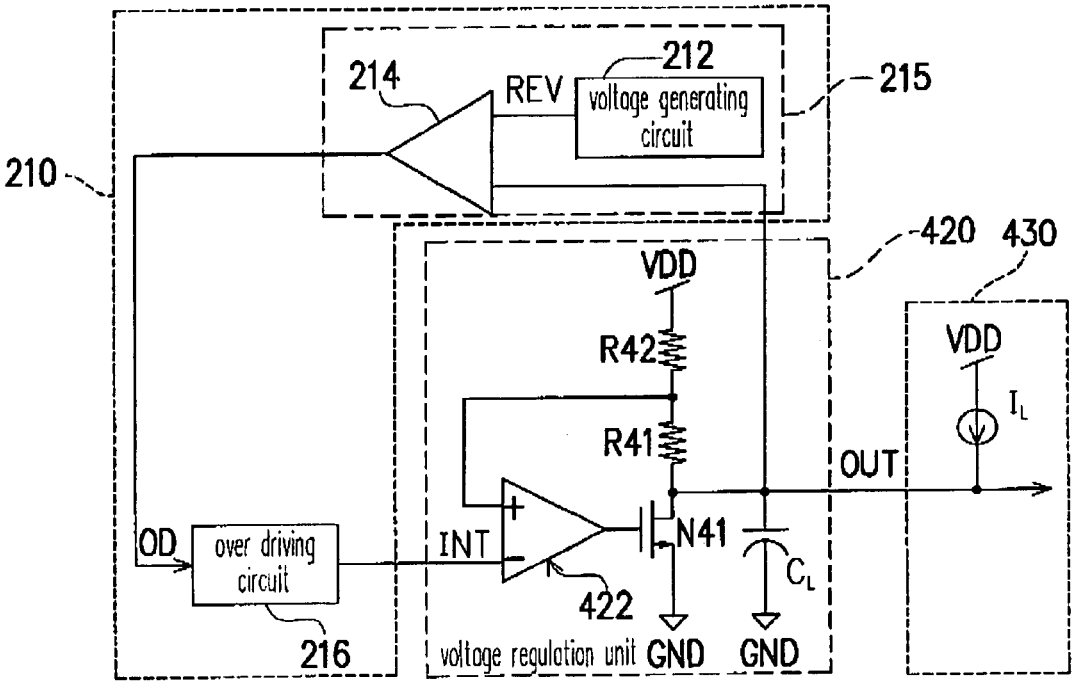
FIG. 4 is a circuit diagram of the voltage regulation unit according to another embodiment of the present invention.

FIG. 4 is a circuit diagram of the voltage regulation unit according to another embodiment of the present invention. The voltage regulation unit 420 is coupled between the over driving unit 210 and a load 430. The voltage regulation unit 420 includes an operational amplifier 422, an N-type transistor (NMOS transistor) N41, and resistors R41, R42. The resistors R41, R42 are coupled in series between the operating voltage VDD and the N-type transistor N41, and the common node of the resistors R41, R42 is coupled to the positive input terminal of the operational amplifier 422. Therefore, the voltage level of the common node of the resistors R41, R42 is equal to the input voltage INT. The output voltage OUT is equal to a sum of subtracting the bias voltage across the resistors R41, R42 from the operating voltage VDD. Those of ordinary skills in the art can easily understand the relative relation between the output voltage OUT and the input voltage INT in FIG. 4 with reference to the disclosure of the present invention, and the details will not be described herein again.

The main difference between the load 430 of the present embodiment and the load 330 in FIG. 3 lies in the current direction of the load current $I_L$. The present invention is not intended to limit the load to the equivalent circuits of the above loads 330, 430, and it should be understood that the voltage regulator circuit of the present embodiment is applicable to loads of various forms.

Figure 5:
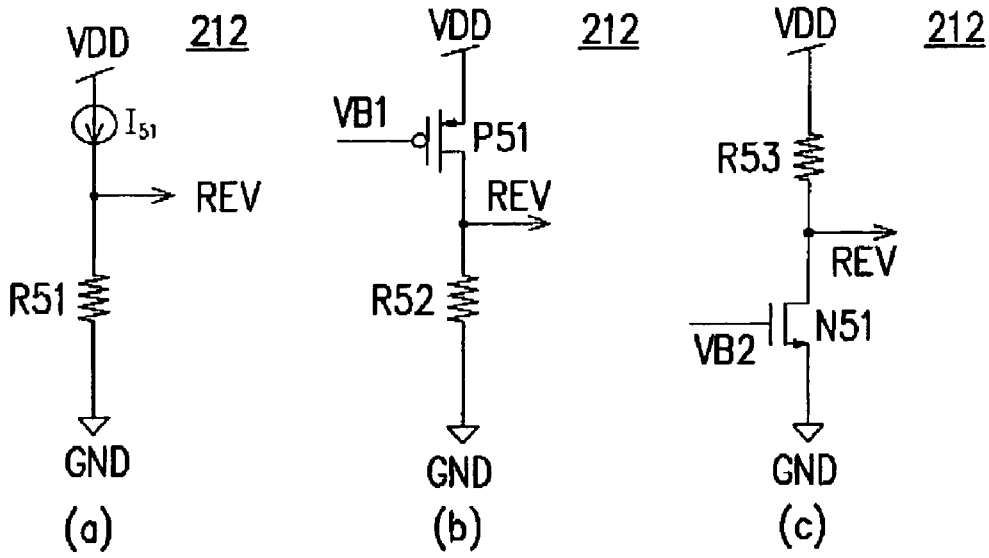
FIG. 5 is a circuit diagram of the voltage generating circuit according to an embodiment of the present invention.

Then, the implementation of the voltage generating circuit 212 of the present embodiment is further illustrated. FIG. 5 is a circuit diagram of the voltage generating circuit according to the present embodiment. FIG. 5 only illustrates three types of different voltage generating circuits (FIGS. 5(*a*)-5(*c*)). However, the present invention is not limited to this, and any manner that can generate a stable voltage source can be used in the voltage generating circuit of the present embodiment.

In FIG. 5(*a*), the voltage value of the reference voltage REV is regulated by controlling the current value output from a current source $I_{51}$ to a resistor R51. In FIG. 5(*b*), the current source $I_{51}$ is replaced by a current conducted by the P-type transistor P51 which is controlled by a dc bias voltage VB1, so as to control the reference voltage REV generated at the common node of a resistor R52 and the P-type transistor P51. In FIG. 5(*c*), a resistor R53 and an N-type transistor N51 are coupled in series between the operating voltage VDD and an ground terminal GND, such that the voltage value of the reference voltage REV is regulated by controlling the dc bias voltage value of VB2. Those of ordinary skill in the art can easily understand the detail and principle of the circuit operation of FIG. 5 with reference to the disclosure of the present invention, and the details will not be described herein again.

Figure 6:
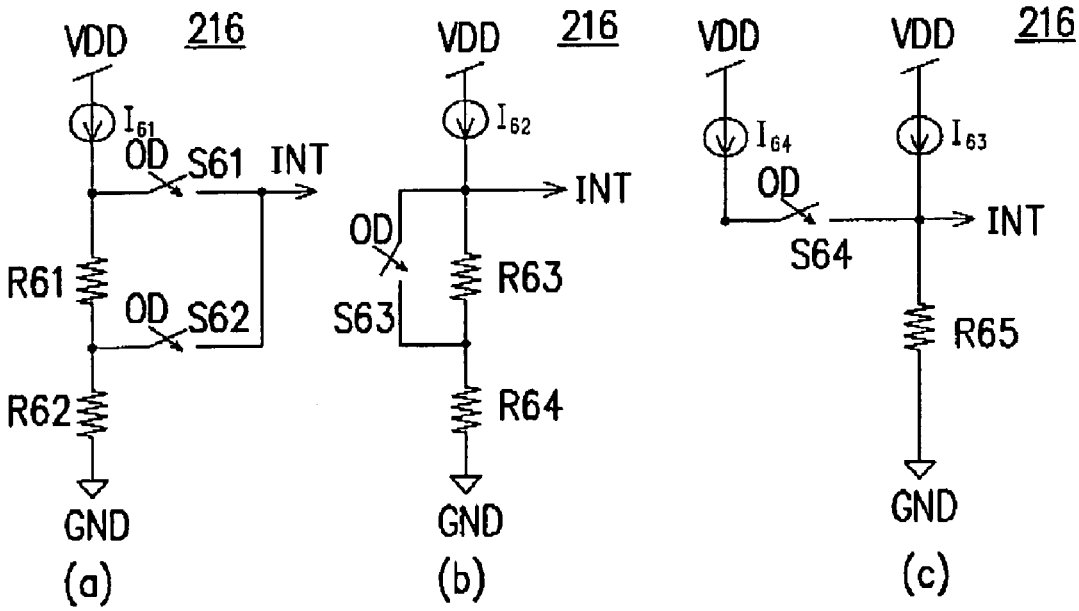
FIG. 6 is a circuit diagram of the over driving circuit according to an embodiment of the present invention.

FIG. 6 is a circuit diagram of the over driving circuit according to the present embodiment. Although only the implementations of three over driving circuits 216 (FIGS. 6(*a*) -6(*c*)) are illustrated in the present invention, it is not limited to this, and any circuit that can regulate the input voltage INT according to the over driving signal OD can be used. However, in the embodiment of FIGS. 6(*a*)-6(*c*), switches S61-S64 are selectively closed or opened in accordance with the over driving signal OD, so as to regulate the input voltage INT. Afterwards, the circuit architectures of FIGS. 6(*a*)-6(*c*) are further illustrated.

In FIG. 6(*a*), the over driving circuit 216 includes resistors R61, R62, switches S61, S62, and a current source $I_{61}$. The resistors R61, R62 are coupled in series between the current source $I_{61}$ and the ground terminal GND. One terminal of the switch S61 is coupled to the common node of the current source $I_{61}$ and the resistor R61, and the other terminal of the switch S61 is coupled to the output terminal of the over driving circuit 216. One terminal of the switch S62 is coupled to the common node of the resistors R61, R62, and the other terminal of the switch S62 is coupled to the output terminal of the over driving circuit 216. The output terminal of the over driving circuit 216 is used to generate the input voltage INT.

The over driving signal OD output by the voltage comparison circuit 215 determines the on/off state of the switches S61, S62. Referring to the embodiment in FIG. 3, in a normal state, when the output voltage OUT is higher than the reference voltage REV, the switch S61 is opened and the switch S62 is closed. When the output voltage OUT becomes lower than the reference voltage REV due to the change of load, the switch S61 is closed and the switch S62 is opened. When the output voltage OUT is higher than the reference voltage REV, it returns to the normal state, i.e., the switch S62 is closed and the switch S61 is opened. The input voltage INT changes along with the on/off state of the switches S61, S62. When the switch S61 is closed, the input voltage INT is larger, and when the switch S62 is closed, the input voltage INT is. apparently smaller since only the voltage difference between the resistor R62 and the ground terminal exists. Thus, the voltage level of the input voltage INT can be regulated by controlling the on/off state of the switches S61, S62. According to the embodiment in FIG. 4, in a normal state, when the output voltage OUT is lower than the reference voltage REV, the switch S61 is closed and the switch S62 is opened. When the output voltage OUT becomes higher than the reference voltage REV due to the change of load, the switch S62 is closed and the switch S61 is opened. When the output voltage OUT is lower than the reference voltage REV, it returns to the normal state, i.e., the switch S61 is closed and the switch S62 is opened.

In FIG. 6(*b*), resistors R63 and R64 are coupled in series between a current source $I_{62}$ and the ground terminal GND. The switch S63 is coupled between both terminals of the resistor R63. Referring to the embodiment in FIG. 3, in a normal state, when the output voltage OUT is higher than the reference voltage REV, the switch S63 is closed. When the output voltage OUT becomes lower than the reference voltage REV due to the change of load, the switch S63 is opened and the input voltage INT rises accordingly. According to the embodiment in FIG. 4, in a normal state, when the output voltage OUT is lower than the reference voltage REV, the switch S63 is opened. When the output voltage OUT becomes higher than the reference voltage REV due to the change of load, the switch S63 is closed and the input voltage INT decreases accordingly.

In FIG. 6(*c*), a current source $I_{63}$ is coupled to a resistor R65. One terminal of the switch S64 is coupled to another current source $I_{64}$, and the other terminal of the switch S64 is coupled to the common node of the current source $I_{63}$ and the resistor R65. Referring to the embodiment in FIG. 3, in a normal state, when the output voltage OUT is higher than the reference voltage REV, the switch S64 is opened. When the output voltage OUT becomes lower than the reference voltage REV due to the change of load, the switch S64 is closed and the currents of the current sources $I_{63}$, $I_{64}$ passes through the resistor R65. Thus, the input voltage INT rises accordingly. According to the embodiment in FIG. 4, in a normal state, when the output voltage OUT is lower than the reference voltage REV, the switch S64 is closed. When the output voltage OUT becomes higher than the reference voltage REV due to the change of load, the switch S64 is opened and only the current of the current source $I_{63}$ passes through the resistor R65. Thus, the input voltage INT decreases accordingly.

According to the above embodiment in FIGS. 6(*a*)-(*c*), the impact of the change of load on the output voltage can be alleviated by regulating the predetermined relation between the reference voltage and the output voltage according to the circuit architectures of different over driving circuits. By setting an appropriate reference voltage together with a corresponding over driving circuit architecture, when the load changes, not only the phenomenon of output voltage drop but also the phenomenon of voltage swell can be alleviated, such that the voltage regulator has a more stable output voltage. The aforementioned FIGS. 6(*a*)-(*c*) only show the embodiments of the present invention, and are not intended to limit the circuit architecture of the over driving circuit of the present invention. Those of ordinary skills in the art can easily deduce other applicable circuit architectures with reference to the disclosure of the present invention, and the details will not be described herein again.

In another embodiment of the present invention, the principle of resistor voltage division is adopted to provide a plurality of voltage levels according to the comparison result between the output voltage OUT and the reference voltage REV. The input voltage INT of the voltage regulator 200 changes by the use of the aforementioned voltage levels. Meanwhile, the magnitude of change of the input voltage INT can also be regulated according to the magnitude of change of the output voltage OUT, so as to maintain the stability of the output voltage OUT. Those of ordinary skills in the art can easily understand the implementation of using the resistor voltage division as the input voltage INT with reference to the disclosure of the present invention, and the details will not be described herein again.

The present invention utilizes the principle of over driving. When the output voltage changes due to the transient response of the load current, the voltage regulator can regulate the voltage level of the input voltage in real time to enhance the driving capability of the voltage regulator, thereby alleviating the impact of the change of load on the output voltage.

Though the present invention has been disclosed above by the preferred embodiments, they are not intended to limit the present invention. Anybody skilled in the art can made some modifications and variations without departing from the spirit and scope of the present invention. Therefore, the protecting range of the present invention falls in the appended claims.

What is claimed is:

1. A voltage regulator, comprising:

a voltage regulation unit for comparing a voltage corresponding to an output voltage outputted form the voltage regulation unit with an input voltage and regulating the output voltage according to a first comparison result between the voltage corresponding to the output voltage and the input voltage; and an over driving unit, coupled between an input terminal and an output terminal of the voltage regulation unit, and regulating the input voltage according to a second comparison result between the output voltage and a reference voltage, wherein the over driving unit comprises:

a voltage comparison circuit, coupled to the output terminal of the voltage regulator for comparing the output voltage of the voltage regulator and a reference voltage and outputting an over driving signal;

an over driving circuit, coupled between the voltage comparison circuit and the input terminal of the voltage regulation unit, and regulating the input voltage of the voltage regulation unit according to the over driving signal, wherein the over driving circuit comprises:

a current source;

a first resistor and a second resistor, coupled in series between the current source and a ground terminal;

a first switch with one terminal coupled to the common node of the current source and the first resistor, and another terminal coupled to the output terminal of the over driving circuit; and a second switch with one terminal coupled to the common node of the first resistor and the second resistor, and another terminal coupled to the output terminal of the over driving circuit, wherein when the output voltage is higher than the reference voltage, the first switch is opened and the second switch is closed; when the output voltage is lower than the reference voltage, the first switch is closed and the second switch is opened; and the output terminal of the over driving circuit outputs the input voltage of the voltage regulation unit.

2. The voltage regulator as claimed in claim 1, wherein the voltage regulation unit comprises:

an operational amplifier, having a positive input terminal, a negative input terminal, and an output terminal, wherein the negative input terminal of the operational amplifier is coupled to the input voltage;

a P-type transistor, coupled between an operating voltage and a first resistor, wherein the gate of the P-type transistor is coupled to the output terminal of the operational amplifier;

a second resistor, coupled between another terminal of the first resistor and a ground terminal, wherein the common node of the first resistor and the second resistor is coupled to the positive input terminal of the operational amplifier; and a capacitor, coupled between the output terminal of the voltage regulation unit and a ground terminal;

wherein the negative input terminal of the operational amplifier is the input terminal of the voltage regulation unit, and the common node of the P-type transistor and the first resistor is the output terminal of the voltage regulation unit for generating the output voltage.

3. The voltage regulator as claimed in claim 2, wherein when the output voltage is lower than the reference voltage, the input voltage is risen.

4. The voltage regulator as claimed in claim 1, wherein the voltage regulation unit comprises:

an operational amplifier, having a positive input terminal, a negative input terminal, and an output terminal, wherein the negative input terminal of the operational amplifier is coupled to the input voltage;

an N-type transistor, coupled between a first resistor and a ground terminal, wherein the gate of the N-type transistor is coupled to the output terminal of the operational amplifier;

a second resistor, coupled between an operating voltage and the other terminal of the first resistor, wherein the common node of the first resistor and the second resistor is coupled to the positive input terminal of the operational amplifier; and a capacitor, coupled between the output terminal of the voltage regulation unit and a ground terminal;

wherein the negative input terminal of the operational amplifier is the input terminal of the voltage regulation unit, and the common node of the N-type transistor and the first resistor is the output terminal of the voltage regulation unit for generating the output voltage.

5. The voltage regulator as claimed in claim 4, wherein when the output voltage is higher than the reference voltage, the input voltage is decreased.

6. The voltage regulator as claimed in claim 1, wherein the voltage comparison circuit comprises:

a voltage generating circuit, for generating the reference voltage; and a comparator, for comparing the output voltage of the voltage regulator and the reference voltage, and outputting an over driving signal to the over driving circuit.

7. The voltage regulator as claimed in claim 6, wherein the voltage generating circuit comprises:

a resistor with one terminal coupled to a ground terminal; and a P-type transistor, coupled between an operating voltage and another terminal of the resistor, wherein the gate of the P-type transistor is coupled to a DC bias, and the common node of the P-type transistor and the resistor outputs the reference voltage.

8. The voltage regulator as claimed in claim 6, wherein the voltage generating circuit comprises:

a current source; and a resistor, coupled between the current source and a ground terminal, wherein the common node of the resistor and the current source outputs the reference voltage.

9. The voltage regulator as claimed in claim 6, wherein the voltage generating circuit comprises:

a resistor with one terminal coupled to an operating voltage; and an N-type transistor, coupled between another terminal of the resistor and a ground terminal, wherein the gate of the N-type transistor is coupled to a DC bias, and the common node of the N-type transistor and the resistor outputs the reference voltage.

10. A voltage regulator, comprising:

a voltage regulation unit for comparing a voltage corresponding to an output voltage outputted form the voltage regulation unit with an input voltage and regulating the output voltage according to a first comparison result between the voltage corresponding to the output voltage and the input voltage; and an over driving unit, coupled between an input terminal and an output terminal of the voltage regulation unit, and regulating the input voltage according to a second comparison result between the output voltage and a reference voltage, wherein the over driving unit comprises:

a voltage comparison circuit, coupled to the output terminal of the voltage regulator for comparing the output voltage of the voltage regulator and a reference voltage and outputting an over driving signal;

an over driving circuit, coupled between the voltage comparison circuit and the input terminal of the voltage regulation unit, and regulating the input voltage of the voltage regulation unit according to the over driving signal, wherein the over driving circuit comprises:

a current source;

a first resistor and a second resistor, coupled in series between the current source and a ground terminal; and a switch with one terminal coupled to the common node of the current source and the first resistor, another terminal coupled to the common node of the first resistor and the second resistor, and the common node of the current source and the first resistor is the output terminal of the over driving circuit, wherein when the output voltage is higher than the reference voltage, the switch is closed; when the output voltage is lower than the reference voltage, the switch is opened; and the output terminal of the over driving circuit outputs the input voltage of the voltage regulation unit.

11. A voltage regulator, comprising:

a voltage regulation unit for comparing a voltage corresponding to an output voltage outputted form the voltage regulation unit with an input voltage and regulating the output voltage according to a first comparison result between the voltage corresponding to the output voltage and the input voltage; and an over driving unit, coupled between an input terminal and an output terminal of the voltage regulation unit, and regulating the input voltage according to a second comparison result between the output voltage and a reference voltage, wherein the over driving unit comprises:

a voltage comparison circuit, coupled to the output terminal of the voltage regulator for comparing the output voltage of the voltage regulator and a reference voltage and outputting an over driving signal;

an over driving circuit, coupled between the voltage comparison circuit and the input terminal of the voltage regulation unit, and regulating the input voltage of the voltage regulation unit according to the over driving signal, wherein the over driving circuit comprises:

a first current source;

a second current source;

a resistor, coupled between the first current source and a ground terminal; and a switch with one terminal coupled to the second current source, and another terminal coupled to the common node of the first current source and the resistor, wherein when the output voltage is higher than the reference voltage, the switch is opened; when the output voltage is lower than the reference voltage, the switch is closed; and the output terminal of the over driving circuit outputs the input voltage of the voltage regulation unit.

* * * * *